US005211570A

United States Patent [19]

Bitney

[11] Patent Number: 5,211,570

[45] Date of Patent: May 18, 1993

[54] CORD CONNECTION SYSTEM

[76] Inventor: Wesley E. Bitney, P.O. Box 443, Norfolk, Nebr. 68702

[21] Appl. No.: 889,610

[22] Filed: May 27, 1992

[51] Int. Cl.[5] ..... H01R 4/38

[52] U.S. Cl. ..... 439/320; 439/536

[58] Field of Search ..... 439/312, 313, 536, 320, 439/562, 321, 564, 322, 323, 253

[56] References Cited

U.S. PATENT DOCUMENTS

| | | | |
|---|---|---|---|
| 3,390,371 | 6/1968 | Kramer . | |
| 3,824,526 | 7/1974 | Glover | 439/320 X |
| 4,066,314 | 1/1978 | Williams | 439/320 X |
| 4,820,185 | 4/1989 | Moulin | 439/321 |
| 5,035,646 | 7/1991 | Ehrenfels et al. | 439/536 |
| 5,087,209 | 2/1992 | Faucher | 439/320 |

*Primary Examiner*—Larry I. Schwartz
*Assistant Examiner*—Khiem Nguyen
*Attorney, Agent, or Firm*—Zarley, McKee, Thomte, Voorhees & Sease

[57] ABSTRACT

A cord connection system includes a male plug on an electrical cord having conventional blades projecting therefrom. A female receptacle has conventional blade terminals for connection with the plug, and includes a locking ring rotatably mounted on a receptacle body, the ring being interiorly threaded to engage exterior threads on the body of the male plug. A flange on the forward end of the receptacle retains the ring on the receptacle so that the plug and receptacle are locked together when the locking ring is engaged on the plug thread. A receptacle end piece is provided which maintains the locking ring in position on the end of an electrical cord, in one embodiment of the invention. In a second embodiment of the invention the receptacle end piece is mounted on the rearward surface of a wall plate such that the receptacle projects through the wall plate with the locking ring and blade terminals projecting forwardly of the wall plate. In this fashion, the threaded male plug may be locked to a receptacle on a wall plate on a conventional wall outlet box.

5 Claims, 4 Drawing Sheets

CORD CONNECTION SYSTEM

TECHNICAL FIELD

The present invention relates generally to electrical cord, plugs and connectors, and more particularly to an improved structure for securely connecting a plug to a receptacle to prevent accidental separation.

BACKGROUND OF THE INVENTION

Electrical cords extending from power tools and the like have a male plug end which is receivally connected in a female receptacle on an extension cord or in a wall outlet. In construction and the like it is not uncommon for a tool operator to move extensively on a job site. This movement loosens the plug connection with the receptacle on the extension cord or outlet, until the tool becomes disconnected. Not only is such disconnection frustrating, but also requires additional time to reconnect the plug. Wear and tear on the plug and receptacle is also increased in such circumstances.

It is therefore a general object of the present invention to provide an improved cord connection system which maintains the connection of a plug in a receptacle against axial forces applied to the plug or receptacle.

Yet another object of the present invention is to provide a cord connection system which is simple and quick to connect and disconnect.

A further object is to provide a cord connection system which may be attached to existing tools and outlets or junction boxes.

Yet another object of the present invention is to provide a cord connection system which is economical to manufacture and refined in appearance.

These and other objects will be apparent to those skilled in the art.

SUMMARY OF THE INVENTION

The cord connection system of the present invention includes a male plug on an electrical cord having conventional blades projecting therefrom. A female receptacle has conventional blade terminals for connection with the plug, and includes a locking ring rotatably mounted on a receptacle body, the ring being interiorly threaded to engage exterior threads on the body of the male plug. A flange on the forward end of the receptacle retains the ring on the receptacle so that the plug and receptacle are locked together when the locking ring is engaged on the plug thread. A receptacle end piece is provided which maintains the locking ring in position on the end of an electrical cord, in one embodiment of the invention. In the second embodiment of the invention the end piece is mounted on the rearward surface of a wall plate such that the receptacle projects through the wall plate with the locking ring and blade terminals projecting forwardly of the wall plate. In this fashion, the threaded male plug may be locked to a receptacle on a wall plate on a conventional wall outlet box. An end piece is also provided to permit mounting of receptacles in a junction box to permit locked connection of threaded plugs with receptacles on the junction box.

DESCRIPTION OF THE PREFERRED EMBODIMENTS

Figure 1:
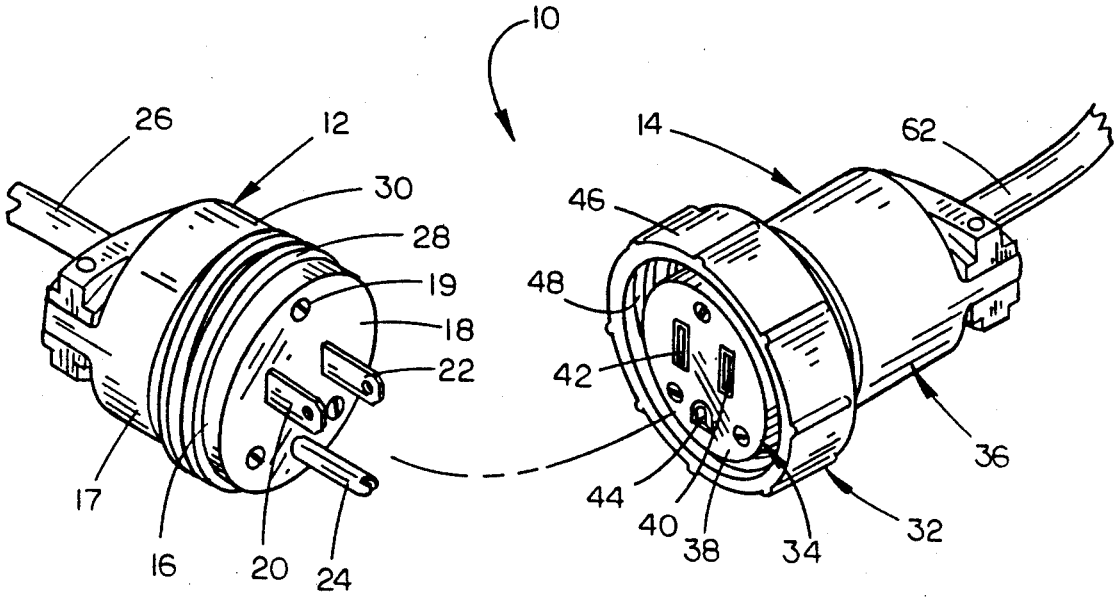
FIG. 1 is a perspective view of a plug and extension cord receptacle utilizing the connection system of the present invention.

Referring now to the drawings, in which similar or corresponding parts are identified with the same reference numeral, and more particularly to FIG. 1, the cord connection system of the present invention is designated generally at 10 and includes a male plug portion designated generally at 12 and a female receptacle portion designated generally at 14.

Plug 12 includes a generally cylindrical body 16 having a forward face 18 with a pair of electrical blades 20 and 22 projecting from forward face 18. In three wire electrical cords, a ground pin 24 also projects from face 18. Body 16 is removably connected to an end piece 17, utilizing screws 19, which is mounted on the end of cord 26. Blades 20 and 22, and ground pin 24, are all electrically connected to electrical wires within cord 26 extending from end piece 17, in a conventional fashion. Thus, plug 12 may be an accessory unit which is added to an existing cord 26, or may be molded simultaneously with cord 26.

A square thread 28 is formed on the outer cylindrical surface 30 of body 16, adjacent the forward face 18 thereof.

Figure 3:
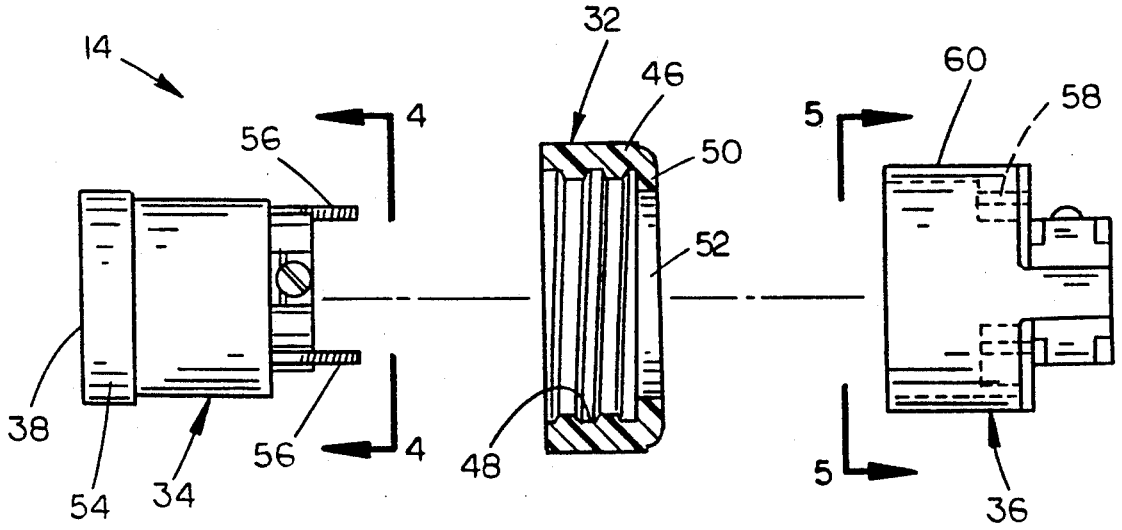
FIG. 3 is an exploded side elevational view of the female receptacle of FIG. 1 connected together.

Referring now to FIG. 3, receptacle 14 includes a locking ring 32 rotatably mounted on a generally cylindrical body 34 with a rearward end piece 36 connected to body 34 to retain ring 32 thereon. As shown in FIG. 1, receptacle body 34 includes a forward face 38 having a pair of blade terminals 40 and 42 and a ground terminal 44 formed therein to receive blades 20 and 22 and ground pin 24, respectively.

Locking ring 32 includes a generally cylindrical wall 46 having interior threads 48 formed to correspond with threads 28 on plug 12, as shown in FIGS. 1 and 3. An annular lip 50 is directed radially inwardly at the rearward end of cylindrical wall 46, as shown in FIG. 3, to form an aperture 52 having a diameter less than the diameter of flange 54 forming the forward face 38 of receptacle body 34. In this way, lip 50 will abut against flange 54 to lock receptacle body 34 with plug 12 when ring 32 is threaded onto threads 28 of plug 12.

Figure 2:
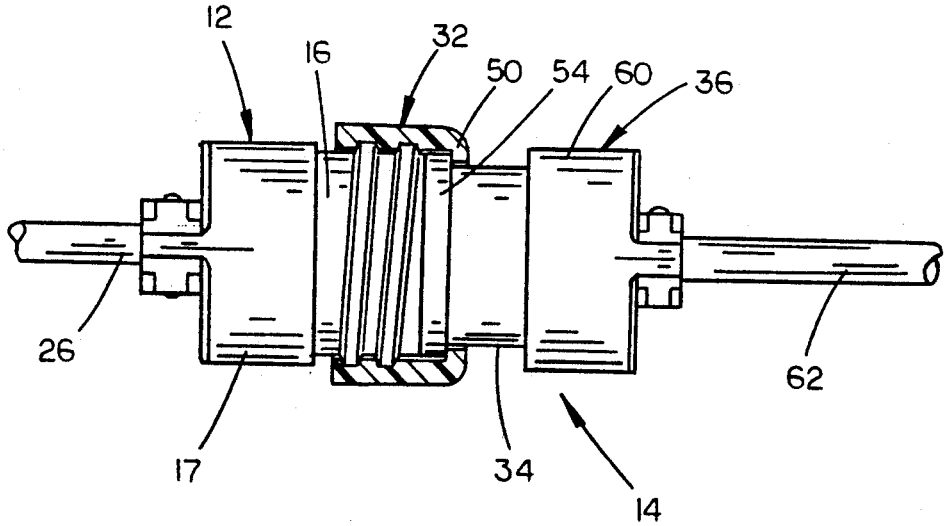
FIG. 2 is a side elevational view of the plug and receptacle of FIG. 1 connected together.
Figure 4:
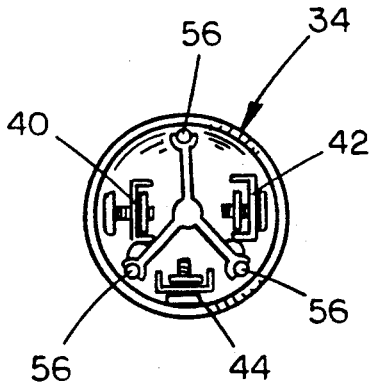
FIG. 4 is a rearward end elevational view taken at lines 4—4 in FIG. 3.
Figure 5:
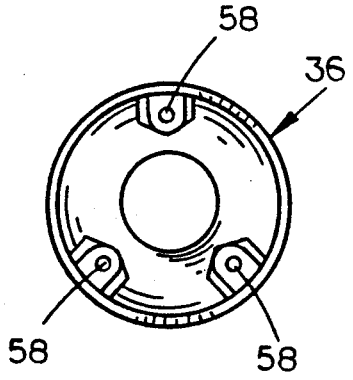
FIG. 5 is a forward end elevational view taken at lines 5—5 in FIG. 3.

Receptacle body 34 has a plurality of screws 56 projecting rearwardly from the rearward end thereof which are threaded into correspondingly threaded apertures 58 in rearward end piece 36, as shown in FIGS. 3, 4 and 5. Preferably, end piece 36 has a forward cylindrical portion 60 which will receive the rearward end of receptacle body 34 partially wherein, the diameter of forward portion 60 being greater than the diameter of body 34. In this way, locking ring 32 is maintained on receptacle body 34 between flange 54 and rearward end piece 36, as shown in FIG. 2. An electrical cord 62 extends rearwardly from female receptacle 14, and is connected to blade terminals 40 and 42 and ground pin terminal 44 in a conventional fashion.

In use, male plug 12 and female receptacle 14 may be molded in pieces on a power tool cord and/or extension cord, or may be separately attachable replacement parts therefore. Plug 12 is electrically connected to receptacle 14 in a conventional fashion, with blades 20 and 22 and ground pin 24 inserted in blade terminals 40 and 42 and ground terminal 44. Locking ring 32 is then engaged on threads 28 on plug 12 with one-half of a full rotation of locking ring 32. It can be seen that once locking ring 32 engages threads 28 on plug 12, plug 12 and receptacle 14 are prevented from axial disconnection, as shown in FIG. 2.

Figure 6:
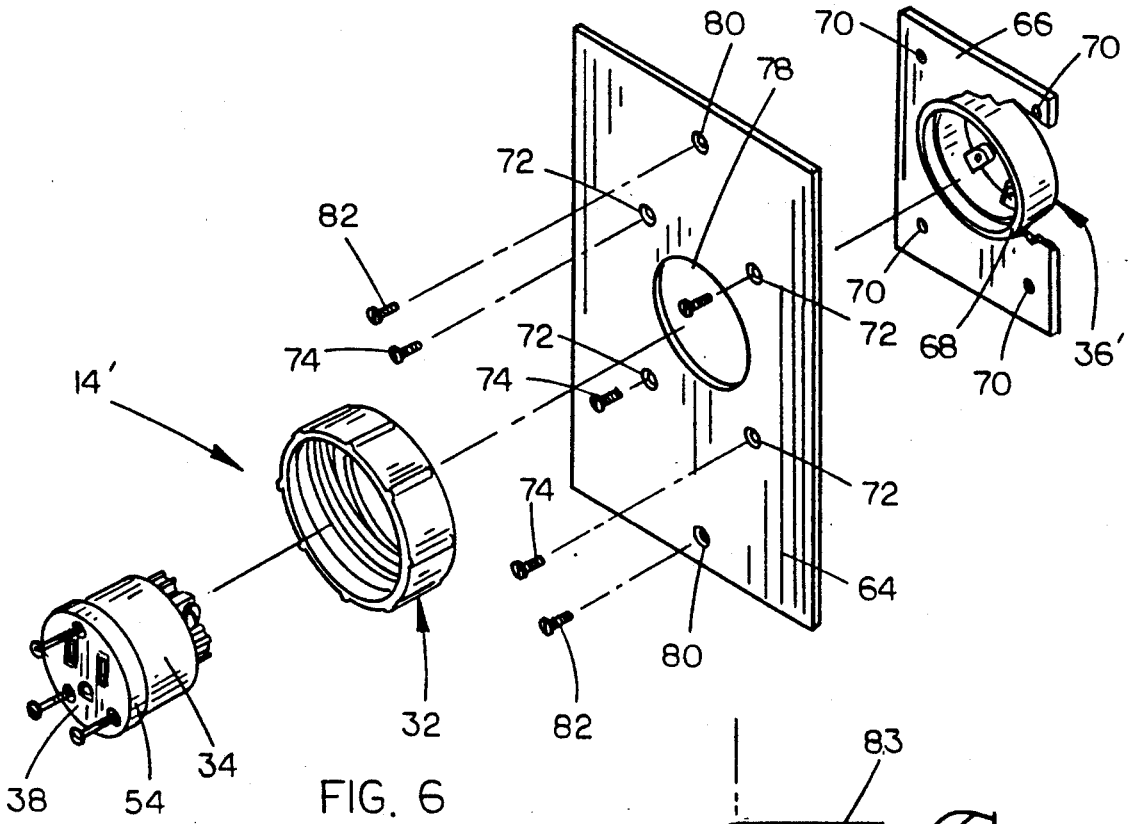
FIG. 6 is an exploded perspective view of a female receptacle applied to an outlet cover.
Figure 7:
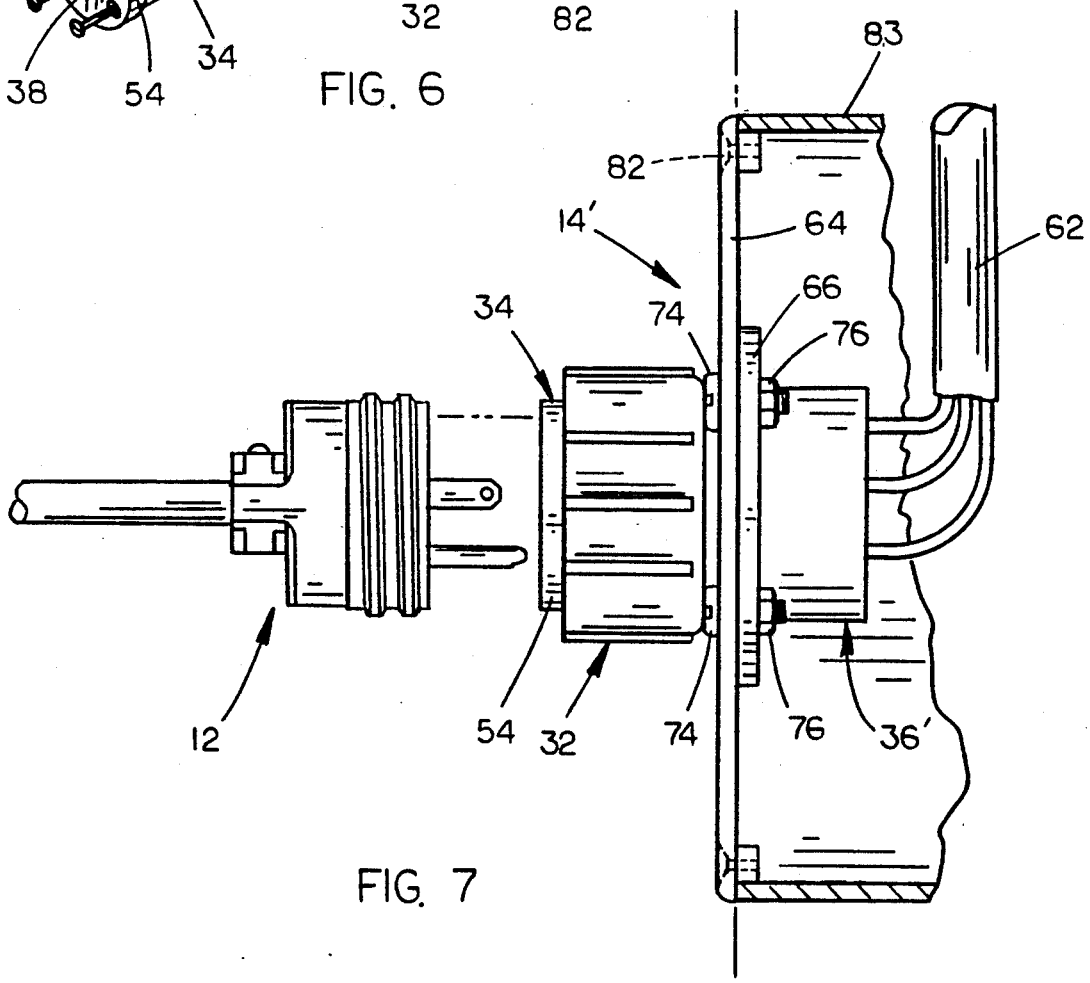
FIG. 7 a side elevational view of the embodiment shown in FIG. 6.

Referring now to FIGS. 6 and 7, a second embodiment of the invention includes the same male plug 12 with a modified female receptacle 14', which is connected to a wall plate 64. As shown in FIG. 6, receptacle 14' includes the same receptacle body 34 with forward flange 54 and forward face 38, with the same locking ring 32 rotatably mounted thereon, as the first embodiment of the invention. The main difference in the second embodiment is in the use of a rearward end piece 36' which is modified so as to have a plate 66 mounted flush to the forward edge 68 thereof. End piece 36' is connectable to receptacle body 34 in the same fashion as the first embodiment of the invention.

Plate 66 on end piece 36' includes 4 spaced-apart threaded apertures 70 which correspond with 4 holes 72 formed in wall plate 64. Screws 74 are mounted through holes 72 and thence through apertures 70 and have nuts 76 threaded thereon so as to mount plate 66 to the rearward surface of wall plate 64. A large central opening 78 is formed in wall plate 64 so as to receive the rearward end of receptacle body 34, to permit the connection of body 34 with rearward end piece 36'. As an alternative, wall plate 64 could have end piece 36+ molded simultaneously therewith to form an integral unit, which could then simply replace an existing wall plate on an outlet box.

Wall plate 64 includes upper and lower holes 80 to receive screws 82 so as to connect wall plate 64 to a conventional outlet box 83 in a wall. In this way, a conventional wall outlet may be converted for use with the cord connection system of the present invention so as to securely lock the plug 12 into the receptacle 14', as shown in FIG. 7.

Figure 8:
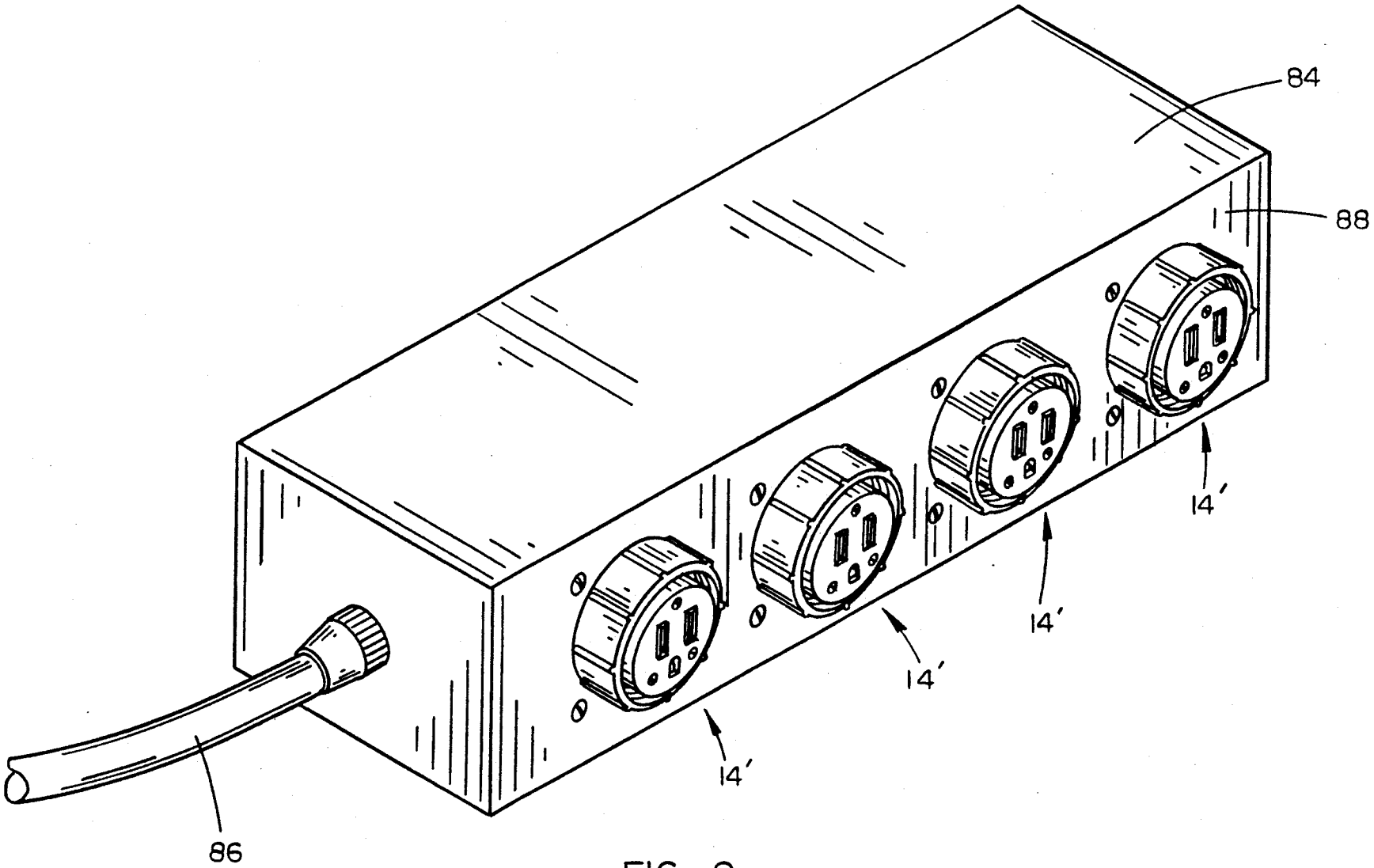
FIG. 8 is a perspective view of a third embodiment of the invention.

Referring now to FIG. 8, a third embodiment of the invention is disclosed wherein a junction box 84 with an electrical cord 86 extending therefrom includes a plurality of female receptacles 14' of the present invention. Receptacles 14' are identical to those of the second embodiment (shown in FIGS. 6 and 7), except there are mounted within a single junction box 84. It is also contemplated that a single plate member 66 (shown in FIG. 6) could be utilized across the back of the entire forward side 88 of junction box 84, rather than individual plate members 66 as described with respect to FIG. 6. Junction box 84 provides a plurality of lockable receptacle connections for the male plug 12 described in the previous embodiments.

Whereas the invention has been shown and described in connection with the preferred embodiments thereof, it will be understood that many modifications, substitutions and additions may be made which are within the intended broad scope of the appended claims. There has therefore been shown and described an improved cord connection system which accomplishes at least all of the above stated objects.

I claim:

1. A cord connection system, comprising:

a first electrical cord having a male plug at one end thereof;

said plug having at least first and second conventional electrical blades projecting forwardly from a forward face of said plug;

said plug having a body portion projecting rearwardly from the forward face with an exteriorly projecting thread formed thereon;

a second electrical cord having at least a first female electrical receptacle at one end thereof;

said first receptacle having conventional electrical blade terminals therein corresponding with said plug blades to form an electrical connection when the blades are inserted in the terminals;

said receptacle having a body portion with a flange formed at a forward end thereof projecting radially outwardly therefrom;

a locking ring rotatably mounted on the body portion of said receptacle having an interiorly threaded wall adapted to engage said plug thread;

said locking ring having an annular lip projecting radially inwardly from a rearward end thereof and adapted to engage said flange to prevent removal of said ring from the forward end of the receptacle body; and an end piece means mounted on the rearward end of said receptacle body for preventing removal of said ring off the rearward end of said receptacle body;

said end piece means including means for connecting said end piece to a wall plate of the type having a central opening for receipt of said receptacle body portion therethrough, such that said flange and locking ring are located forwardly of the wall plate and said end piece is located rearwardly of the wall plate.

2. The cord connection system of claim 1, wherein said means for connecting said end piece to said wall plate includes a plate mounted to the forward end of said end piece, and fastener means for fastening the plate to said wall plate.

3. The cord connection system of claim 1, wherein said wall plate includes means for fastening the wall plate to a conventional wall outlet box, and wherein said second electrical cord is located within the wall and connected to the receptacle through said wall outlet box.

4. In combination:

a wall plate having a central opening therethrough;

means on said wall plate for fastening the wall plate to a conventional wall outlet box;

a female electrical receptacle connected to said wall plate and electrically connected to an electrical cord extending within said wall outlet box;

said receptacle including a body portion extending through said wall plate opening with a forward face projecting forwardly and outward from said wall plate;

said receptacle forward face having conventional electrical blade terminals therein electrically connected to said electrical cord in said junction box;

said receptacle body portion having a flange formed at the forward end thereof and projecting radially outwardly therefrom forwardly of said wall plate;

a locking ring rotatably mounted on the body portion of receptacle rearwardly of said flange and forwardly of said wall plate, having an interiorly threaded wall;

means on said locking ring for preventing removal of the locking ring forwardly past the forward flange of said receptacle body;

end piece means mounted on the rearward end of said receptacle body and connected to said wall plate to retain said receptacle in said wall plate opening; and a male electrical plug mounted on one end of an electrical cord, for removable electrical connection with said female electrical receptacle;

said plug having a body portion with forward and rearward ends, and a forward face at the forward end of said body portion;

said plug having conventional electrical blades projecting forwardly from said forward face and electrically connected to said plug electrical cord, said electrical blades corresponding with said receptacle blade terminals to form an electrical connection when the blades are inserted in the terminals;

said plug having an exteriorly projecting thread formed on said body portion, corresponding with the interiorly threaded locking ring and located to engage said locking ring when the plug blades are inserted within the receptacle blade terminals.

5. A cord connection system, comprising:

a first electrical cord having a male plug at one end thereof;

said plug having at least first and second conventional electrical blades projecting forwardly from a forward face of said plug;

said plug having a body portion projecting rearwardly from the forward face with an exteriorly projecting thread formed thereon;

a second electrical cord having at least a first female electrical receptacle at one end thereof;

said first receptacle having conventional electrical blade terminals therein corresponding with said plug blades to form an electrical connection when the blades are inserted in the terminals;

said receptacle having a body portion with a flange formed at a forward end thereof projecting radially outwardly therefrom;

a locking ring rotatably mounted on the body portion of said receptacle having an interiorly threaded wall adapted to engage said plug thread;

said locking ring having an annular lip projecting radially inwardly from a rearward end thereof and adapted to engage said flange to prevent removal of said ring from the forward end of the receptacle body;

an end piece means mounted on the rearward end of said receptacle body for preventing removal of said ring off the rearward end of said receptacle body;

said first receptacle being mounted in a forward wall of a junction box, and said second cord extending outwardly from said junction box;

said junction box forward having an opening therein through which said receptacle body projects, with said locking ring located outside the forward wall and the rearward end piece located within the junction box;

at least a second female electrical receptacle electrically connected to said second electrical cord within said junction box;

said second receptacle including a body portion extending through an opening in the forward face of said junction box, adjacent and spaced-apart from said first receptacle;

said second receptacle having a locking ring rotatably mounted thereon with an interiorly threaded wall adapted to engage said plug thread; and an end piece means mounted on the rearward end of said second receptacle body for connecting said receptacle body to said junction box forward wall.

* * * * *